US005802193A

United States Patent [19]

Kieltyka

[11] Patent Number: 5,802,193

[45] Date of Patent: Sep. 1, 1998

[54] OUTDOOR LOUDSPEAKER SYSTEM

[76] Inventor: William J. Kieltyka, 18 Meredith Dr., Brunswick, Me. 04011

[21] Appl. No.: 826,951

[22] Filed: Apr. 8, 1997

[51] Int. Cl.[6] ..... H04R 25/00

[52] U.S. Cl. ..... 381/188; 381/189; 381/199

[58] Field of Search ..... 381/87, 88, 89, 381/90, 159, 188, 205, 189, 153; 181/149, 150, 156, 199; 340/387.1, 391.1, 396.1

[56] References Cited

U.S. PATENT DOCUMENTS 4,949,386 8/1990 Hill ..... 381/189

*Primary Examiner*—Huyen Le

*Attorney, Agent, or Firm*—Frederick R. Cantor, Esq.

[57] ABSTRACT

A partially-buried outdoor loudspeaker assembly includes a concealed loudspeaker mounted on the upper end of a tubular enclosure located largely underground. A protective dome is connected to the upper end of the enclosure by an outwardly radiating connector wall that provides support for a plurality of angled sound port tubes located within a chamber formed by the protective dome.

13 Claims, 1 Drawing Sheet

OUTDOOR LOUDSPEAKER SYSTEM

This invention relates to an outdoor loudspeaker system, and particularly to a loudspeaker system adapted to be partially buried in the ground, whereby the system is both protected and relatively unobtrusive.

Outdoor loudspeaker systems are sometimes used in residential backyards, or theme parks, for broadcasting music, speeches, etc. Such loudspeaker systems include above-ground cabinets or enclosures for containing and protecting the loudspeaker and associated electronics from the weather elements.

One problem with an above-ground cabinet is that it is subject to being stolen. Another problem with such a cabinet is that it usually is not very attractive, in an ornamental esthetic sense.

The present invention is concerned with an outdoor loudspeaker system adapted to be partially buried in the ground, whereby the system is at least partially protected against being stolen or damaged by persons moving within the immediate area. The partially buried loudspeaker system is also semi-concealed from view, so that it is relatively inconspicuous and unobtrusive in appearance.

In preferred practice of the invention, the outdoor loudspeaker system comprises a tubular enclosure adapted to be partially buried in the ground so that only the upper end of the enclosure is above ground level. The loudspeaker per se is mounted in the upper end of the enclosure in an upwardly-facing orientation, whereby the acoustic output is directed generally upwardly away from the ground surface.

The loudspeaker is protected by an overlying protective dome that is attached to the tubular enclosure by an annular wall structure radiating from the upper end of the enclosure. A plurality of open-ended sound port tubes are mounted on the annular wall structure in the enclosed space below the protective dome. These sound port tubes are angularly oriented to the axis of the tubular enclosure so as to direct at least some of the acoustic output outwardly and downwardly onto the ground surface at the outer edge of the protective dome.

The dome has a diameter greater than the diameter of the tubular enclosure and loudspeaker, such that it is also relatively difficult for small animals to gain access to the interior space above the loudspeaker. The dome protects against theft or destruction of the operating components by humans, animals or the weather elements.

Further features of the invention will be apparent from the attached drawings and description of a preferred embodiment of the invention.

In summary, and in accordance with the above discussion, the foregoing objectives are achieved in the following embodiments:

DESCRIPTION THE PREFERRED EMBODIMENTS OF THE INVENTION

Figure 1:
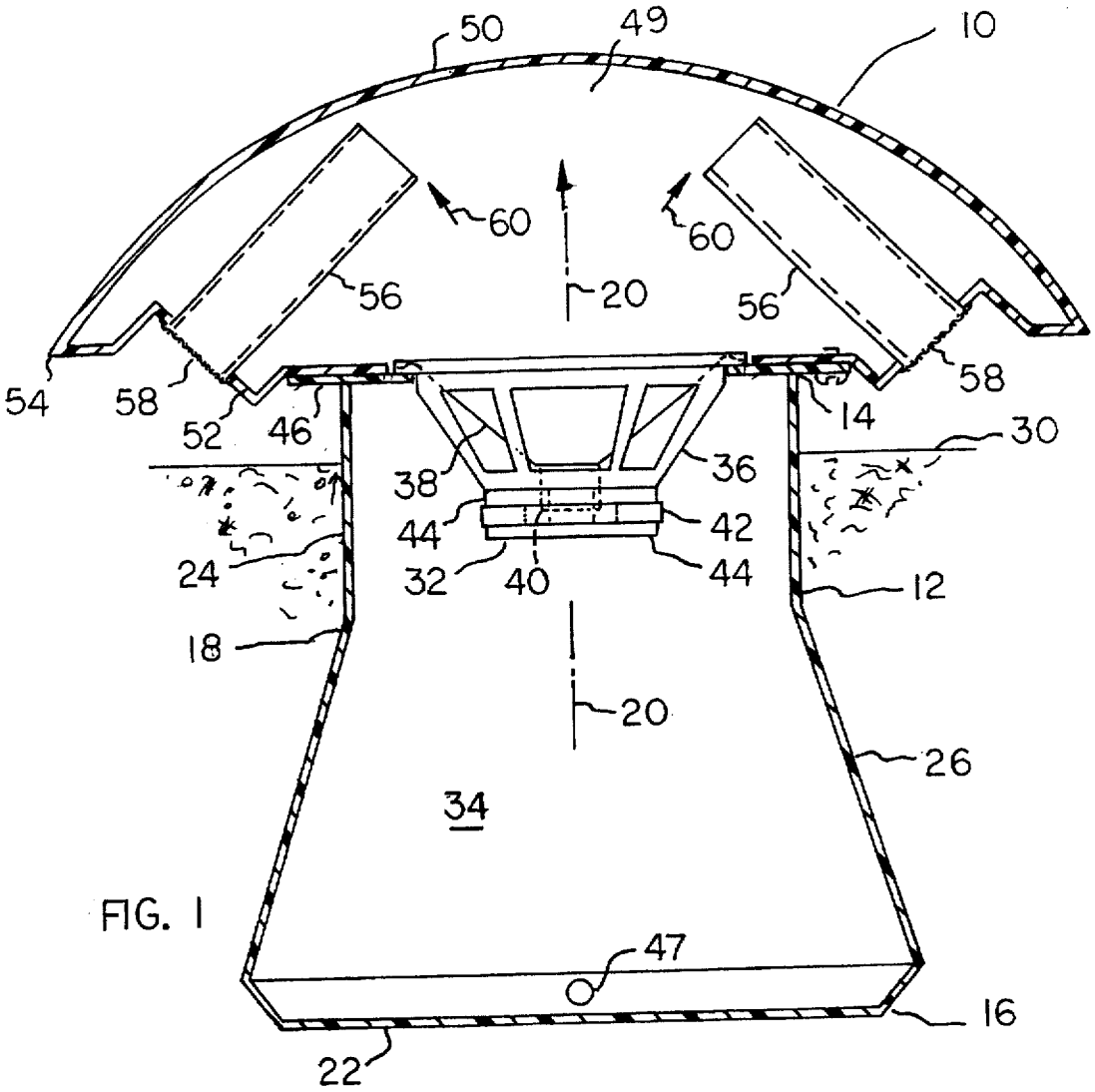
FIG. 1, is a sectional view, taken through a loudspeaker assembly constructed according to the invention.

FIG. 1, is a sectional view, taken through a loudspeaker assembly constructed according to the invention.

Referring to the drawings, and particularly FIG. 1, there is shown an outdoor loudspeaker assembly 10 comprising an upstanding tubular enclosure 12 having an upper end 14 and a lower end 16. The enclosure 12 comprises an annular tubular side wall 18 concentric around a central vertical axis

20, and a bottom wall 22 extending generally transverse to vertical axis 20.

Tubular side wall 18 includes an upper cylindrical wall portion 24 and a lower frusto-conical wall portion 26. The enclosure 12 is adapted for partial burial in the ground, to a position wherein upper end 14 of the enclosure 12 is slightly above ground surface (level) 30.

The enclosure 12 may be constructed in different sizes. However, the enclosure 12 will typically have a vertical length of about fifteen inches and a diameter of about sixteen inches. The upper end of the enclosure can be spaced about one or two inches above ground surface 30.

The frusto-conical wall portion 26 is advantageous in that it can have a stabilizing effect on the enclosure, wherein the enclosure is prevented from being lifted out of the ground. Also the frusto-conical wall 26 may have some advantage in an acoustical sense, in that it may tend to dampen pressure waves generated by the loudspeaker 32 in the below-ground chamber 34.

Loudspeaker 32 can be a conventional loudspeaker that includes a frame (basket) 36, diaphragm 38, voice coil 40, magnet 42, and pole pieces 44. The loudspeaker is mounted on a transverse baffle 46 that spans the upper end of the tubular enclosure 12. The baffle closes the upper end of the enclosure 12, so that chamber 34 is a sealed chamber. Electrical lead wiring for the voice coil can be routed underground through a hole 47 located in the side wall of the enclosure 12.

Chamber 34 can be vacant or it can be filled with energy-absorbing glass wool (not shown). The walls of chamber 34, (enclosure 12), are preferably formed out of durable molded plastic materials, such as polyethylene, fiberglass or high strength composites. Preferably, the side wall 18 of enclosure 12 is tubular in nature, whereby the side 18 wall has a hoop strength that resists inward collapse due to earth pressure forces. The tubular side wall 18 may also have some acoustic advantage in that a curved wall is less resonant than a flat wall. The wall thickness of side wall 18 can be on the order of about 0.25 inch.

Loudspeaker 32 can be a woofer or sub-woofer, designed primarily to generate low frequency bass sounds in the 30 HZ to 125 HZ range. The loudspeaker 32 is oriented to direct the acoustic output vertically upwardly away from ground surface 30, into an above-ground chamber 49, formed by an overhead protective dome (or roof) 50. The imperforate dome 50 is preferably formed out of the same material as enclosure 18 and baffle 46. The volume of chamber 49 is preferably slightly less than the volume of chamber 34.

Dome 50 is supported and connected to enclosure 12 by means of an annular wall 52 that radiates outwardly from the upper end of enclosure 12 to the outer edge of dome 50. Dome 50 is preferably concentric around vertical axis 20, and of sufficient size so that its outer circular edge 54 has a diameter appreciably greater than the corresponding diameter of enclosure 12. Wall 52 can be screwed, or bolted, to baffle 46 for mounting purposes.

Wall 52 forms the lower wall of the above-ground chamber 49. The acoustic output of the loudspeaker 32 is directed upwardly into chamber 49 so as to interact with sound port tubes 56. Each sound port tube 56 is open-ended (both ends), whereby, the port tubes 56 transmit at least some of the acoustic output from chamber 49 into the external space below wall 52. The outer (lower) end of each port tube 56, is preferably equipped with a screen 58 to prevent animals from getting into chamber 49.

Any desired number of sound port tubes 56 can be employed, e.g., two or more tubes. Each tube 56 is located in a vertical radial plane generated from the central vertical axis 20. Also, each tube 56 is oriented so as to be at an acute angle to vertical axis 20, as shown in FIG. 1. Preferably, each tube 56 is angled downwardly and outwardly at an angle of about forty-five (45) degrees to central axis 20.

The angulation of each sound port tube 56 is such that a significant fraction of the acoustic energy generated by the loudspeaker 32 passes transversely across the upper open end of the tube 56, as indicated by arrows 60 in FIG. 1. The acoustic pressure wave passing transversely across the upper end of each port tube 56 creates a rarified condition in the tube by the Bernouilli effect, such as to achieve air oscillation that enhances the acoustic output. The action is somewhat similar to the action that takes place in a pipe organ.

Figure 2:
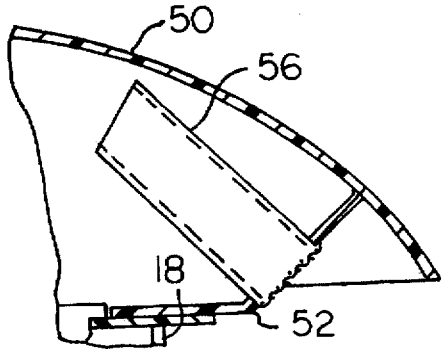
FIG. 2, is a fragmentary sectional view, taken in the same direction as FIG. 1, but showing another embodiment of the invention.

FIG. 2, is a fragmentary sectional view, taken in the same direction as FIG. 1, but showing another embodiment of the invention.

FIG. 2, fragmentarily shows a variant of the invention wherein the annular connecting wall 52, between the dome 50 and enclosure 12, is of a slightly different construction. Also, the upper end of a representative sound port tube 56 is cut at a slightly different angle, that may be beneficial, depending on the divergence of the acoustic wave generated by the loudspeaker 32. FIG. 2, illustrates minor variants that can be employed in practice of the present invention.

The loudspeaker assembly is advantageous in that the above-ground dome (roof) 50 is a small, low profile construction, that is relatively unobstructive and unobtrusive. The loudspeaker 32 is, to a great extent, buried underground so as to be protected against theft or destruction. Small animals and rodents are precluded from getting into chamber 49, so as to not destroy the wiring or to become trapped inside. The loudspeaker assembly can also be left in place for long-term operation without destruction by the weather elements.

In preferred practice of the invention, connector wall 52 is permanently joined to dome (roof) 50 and detachably connected to baffle 46 (e.g. by screws). When the loudspeaker assembly is embedded in the earth, the detachable connections are concealed from view, such that it is essentially impossible to remove the dome from the assembly. the assembly is thus protected from theft or dismantlement.

The present invention, described above, relates to an outdoor loudspeaker system. Features of the present invention are recited in the appended claims. The drawings contained herein necessarily depict structural features and embodiments of the outdoor loudspeaker system, used in the practice of the present invention.

However, it will be appreciated by those skilled in the arts pertaining thereto, that the present invention can be practiced in various alternate forms and configurations. Further, the previous detailed descriptions of the preferred embodiments of the present invention are presented for purposes of clarity of understanding only, and no unnecessary limitations should be implied therefrom. Finally, all appropriate mechanical and functional equivalents to the above, which may be obvious to those skilled in the arts pertaining thereto, are considered to be encompassed within the claims of the present invention.

What is claimed is:

1. An outdoor loudspeaker assembly comprising:

an upstanding tubular enclosure having an upper end and a lower end, said enclosure being adapted for in-ground installation so that its upper end is located above ground level;

a loudspeaker located within said tubular enclosure for directing sound waves upwardly away from ground level;

an imperforate dome mounted on said enclosure directly above the loudspeaker, to form an above-ground chamber; and a plurality of sound port tubes located within said above-ground chamber below said dome for dispersing acoustic energy out of said above-ground chamber; each said tube having a first open end located within said above-ground chamber, and a second open end communicating with the exterior space surrounding said chamber.

2. The loudspeaker assembly, as described in claim 1, and further comprising a baffle spanning the upper end of said enclosure for supporting said loudspeaker and for isolating said above-ground chamber from the space circumscribed by said enclosure.

3. The loudspeaker assembly, as described in claim 2, wherein said enclosure has a vertical axis; and said enclosure having a tubular side wall concentric around said vertical axis to form a below-ground chamber isolated from said above-ground chamber by said baffle.

4. The loudspeaker assembly, as described in claim 3, wherein said below-ground chamber has a greater volume than said above-ground chamber.

5. The loudspeaker assembly, as described in claim 3, wherein said tubular side wall comprises a hollow cylindrical upper section and a hollow frusto-conical lower section.

6. The loudspeaker assembly, as described in claim 1, wherein said tubular enclosure has a vertical axis; said enclosure having a tubular side wall concentric around said vertical axis to form a below-ground chamber; and an annular connector wall extending from said tubular side wall to the undersurface of said protective dome, whereby said annular connector wall forms the lower wall of said above-ground chamber, each said sound port tube being mounted on said annular connector wall.

7. The loudspeaker assembly, as describe in claim 6, wherein said sound port tubes are located within the above-ground chamber.

8. The loudspeaker assembly, as described in claim 6, wherein said sound port tubes are located in radial planes generated from the vertical axis of said tubular enclosure.

9. The loudspeaker assembly, as described in claim 8, wherein each sound port tube is acutely angled to the vertical axis of said tubular enclosure.

10. The loudspeaker assembly, as described in claim 9, wherein each sound port tube is angled to the enclosure axis at about forty five degrees.

11. The loudspeaker assembly, as described in claim 8, wherein each sound port tube extends downwardly and radially away from the vertical axis of the tubular enclosure.

12. The loudspeaker assembly, as described in claim 1, wherein the protective dome has a diameter that is appreciably greater than the diameter of the tubular enclosure.

13. An outdoor loudspeaker assembly comprising:

an upstanding tubular enclosure adapted to be partially embedded in the ground so that the upper end of the enclosure is located above ground level;

a loudspeaker located within said enclosure for directing sound waves upwardly;

an imperforate protective roof structure located directly above the loudspeaker to form an above-ground chamber; and sound port tubes located below said roof structure for dispersing acoustic energy out of said above-ground chamber wherein said roof structure has a greater diameter than the enclosure, such that edge areas of the roof structure overhang the ground surface surrounding the enclosure; and said roof structure having concealed detachable connections with said enclosure.

* * * * *